US005689895A

United States Patent [19]

Sutherland et al.

[11] Patent Number: 5,689,895

[45] Date of Patent: Nov. 25, 1997

[54] PROBE POSITIONING DEVICE FOR A FLASK FREEZE DRYING

[75] Inventors: David T. Sutherland, Kingston, N.Y.; Alan P. MacKenzie, Mercer Island, Wash.; Dean B. Wise, Shokan, N.Y.

[73] Assignee: S.P. Industries, Inc., The Virtis Division, Gardiner, N.Y.

[21] Appl. No.: 742,259

[22] Filed: Oct. 31, 1996

[51] Int. Cl.[6] ..... F26B 13/30

[52] U.S. Cl. ..... 34/92; 215/310; 215/355

[58] Field of Search ..... 34/284, 287, 92; 215/262, 307, 310, 308, 355, 358, 902; 220/789; 422/916

[56] References Cited

U.S. PATENT DOCUMENTS

| | | | |
|---|---|---|---|
| 3,230,954 | 1/1966 | Burgess et al. | 215/355 X |
| 3,238,778 | 3/1966 | Thompson et al. | 73/351 |
| 3,259,991 | 7/1966 | Illich, Jr. | 34/5 |
| 3,286,366 | 11/1966 | Seligman | 34/92 |
| 3,578,195 | 5/1971 | Ogle | 215/47 |
| 3,708,886 | 1/1973 | Ogle | 34/5 |
| 4,084,330 | 4/1978 | Fraser | 34/92 |
| 4,193,402 | 3/1980 | Rumpler | 128/272 |
| 4,306,357 | 12/1981 | Villarejos | 34/284 |
| 4,597,188 | 7/1986 | Trappler | 34/5 |
| 4,742,690 | 5/1988 | Linner | 34/92 X |
| 4,966,469 | 10/1990 | Fraser et al. | 374/208 |
| 5,065,908 | 11/1991 | Mengeu | 215/355 X |
| 5,090,132 | 2/1992 | Kobayashi et al. | 34/92 X |
| 5,344,036 | 9/1994 | Stanescu | 215/251 |
| 5,447,374 | 9/1995 | Fraser et al. | 374/208 |
| 5,487,737 | 1/1996 | Meyer | 604/403 |
| 5,509,551 | 4/1996 | Terrell, II | 215/310 X |
| 5,513,820 | 5/1996 | Meyer | 215/355 X |
| 5,522,155 | 6/1996 | Jones | 34/286 |

OTHER PUBLICATIONS

FTS Systems, Inc. product literature "Universal Product Sensor" available on or before Mar. 24, 1994.

*Primary Examiner*—John M. Sollecito
*Assistant Examiner*—Steve Gravini
*Attorney, Agent, or Firm*—Heslin & Rothenberg, P.C.

[57] ABSTRACT

A device for positioning a probe, such as a temperature sensor, in a flask for freeze drying. The device includes a stopper adapted to be secured to an open end of the flask. The stopper has a center opening and at least one radial opening spaced from the center opening. The radial opening allows for fluid communication between inside and outside of the flask when the stopper is secured to the open end of the flask. The center opening receives a guide tube which extends into the flask and is sized to receive the probe such that substantially no fluid communication between the inside of the flask and the outside of the flask occurs through the guide tube or center opening. A channel formed in an upper surface of the stopper and an O-ring positioned about an outer diameter of a neck of the flask secure the probe in position relative to the guide tube. The multiple radial openings define an annular passageway which mimics fluid communication through a standard slit-type stopper employed in freeze drying.

21 Claims, 4 Drawing Sheets

PROBE POSITIONING DEVICE FOR A FLASK FREEZE DRYING

TECHNICAL FIELD

This invention relates in general to freeze drying apparatus, and more particularly, to a device for center positioning a probe or sensor within a flask used in the freeze drying process, while still providing a fluid communication path for water vapor to escape from the flask during freeze drying.

BACKGROUND ART

Freeze drying has been used for the preservation of a wide variety of foods, pharmaceuticals, and biological products. Freeze drying enables the removal through sublimation of solvents, including water, from a substance without destroying its cellular structure. Through sublimation, the substance being freeze dried remains in a frozen, solid form until it is dried, i.e., until all of the liquid is removed from the substance.

Sublimation occurs when the frozen substance is heat treated in a proper manner. If improperly treated, the frozen solvent within the substance melts rather than vaporizes, damaging the substance and often rendering it unusable. The temperature level within the flask typically used for freeze drying is critical to proper sublimation. Thus, during the freeze drying operation, the temperature of the substance within at least one drying flask on a tray containing multiple flasks is monitored by a temperature sensor, such as a thermocouple. To ensure proper temperature monitoring, the thermocouple should extend through the length of the substance and its end, the point of highest sensitivity, should be adjacent to but not contacting the bottom center of the flask. Once so positioned, the thermocouple can be employed to determine the temperature of the substance in the lower center portion of the flask.

The freeze drying of a substance occurs at the ice interface. It follows, therefore, that a substance contained in a flask will dry from the top downward and from the sides inward, thus leaving the bottom central section the last portion to dry. Since drying of a substance is accompanied by a rise in temperature, it becomes essential to monitor temperature at this critical point so that one may control the freeze drying process accurately either by manual or automatic means. Conventionally, manufacturers do not provide either acceptable mounting regimens or mounting hardware for thermocouples to be positioned in the drying flask(s) for monitoring the freeze drying process.

Devices for positioning a temperature sensor in a freeze drying flask are shown and described in U.S. Pat. Nos. 4,966,469 and 5,447,374. In the first of these patents, a device is described including a stopper which is snap-fittingly secured to a flask. The stopper has an opening approximately in its center through which an annular tube extends into the flask. A thermocouple is coiled around and supported by the annular tube so that its free end is positioned in the center of the flask. The disadvantage of this device is that it is not easily adjustable, making it difficult to use on flasks of various sizes. Also, it is difficult to use such a device in smaller flasks because most of the thermocouple must be coiled around the annular tube.

In the second of these patents, a temperature sensor positioning device is presented wherein a stopper is adapted to be secured to an open end of the flask. The stopper includes a cylindrical portion with an opening through which a tube extends. A clamping mechanism is connected to the tube to secure a probe to the stopper. The clamping mechanism comprises a first flange and a second opposing flange spaced slightly apart from the first flange. An O-ring positioned around the flanges causes them to flex inward to engage and secure the probe between them. Vapor is vented through the center tube via right angle openings in the cylindrical portion of the stopper. While it is possible to change the position of the thermocouple within the flask by removing the O-ring positioned around the flanges holding the probe, the operation requires removal of the stopper from the flask and disassembly of the device. Further, the positioning device described is relatively complex and expensive to fabricate.

Therefore, there remains a need for an easier way to adjust the position of a center probe within a flask having a substance to be monitored, while still providing a simpler and more economical design than prior probe positioning devices for a freeze-drying flask.

DISCLOSURE OF INVENTION

Briefly summarized, the present invention comprises in one aspect a device for positioning a probe in a flask. The device comprises a stopper and a guide tube. The stopper, which is adapted to be secured to an open end of the flask, has a center opening and at least one radial opening spaced from the center opening. The at least one radial opening allows fluid communication between the inside of the flask and the outside of the flask when the stopper is secured to the open end. The guide tube is held within the center opening and extends into the flask when the stopper is secured to the open end of the flask. The guide tube is sized to receive the probe and allow the probe to extend from the guide tube into the flask. When so assembled, the center opening with the guide tube and probe held therein allow substantially no fluid communication between the inside of the flask and the outside of the flask. Numerous enhancements to this basic device are described and claimed herein.

In a more specific aspect, the present invention comprises a device for positioning a probe in a flask for freeze drying. The device includes a stopper adapted to be secured to an open end of the flask defined at a neck of the flask. The stopper has a center opening and multiple radial openings spaced from the center opening. Each radial opening comprises an arcuate-shaped opening located at a common radius from the center opening, wherein the multiple radial openings comprise an annualar-shaped passageway for fluid communication between inside and outside of the flask when the stopper is secured to the open end of the flask. The stopper comprises a disc-shaped member and a cylindrical member depending therefrom sized to reside within an inner diameter of the neck of the flask. Each radial opening comprises an arcuate-shaped opening in the disc-shaped member and a corresponding channel formed in an outer circumference of the cylindrical member. The device further comprises a guide tube held within the center opening and extending into the flask when the stopper is secured to the open end of the flask. The guide tube is sized to receive the probe and allow the probe to extend from the guide tube into the flask. The center opening with the guide tube and probe held therein allows substantially no fluid communication between the inside of the flask and the outside of the flask when the stopper is secured to the open end of the flask.

In all aspects, the present invention comprises a device which provides an easier way to adjust a center disposed thermocouple, or similar probe, within any sized freeze drying flask. A freeze drying flask with the probe positioning device of the present invention is easy to use, rugged, autoclavable and provides virtually no thermal path through the device to the product. The probe positioning device and associated flask can be adjacent to conventional flasks without impeding stoppering of the conventional flasks or interfering with the freeze drying process. A probe positioning device in accordance with this invention can be readily sized to fit flasks from 2 milliliters to 125 milliliters, with various neck openings, and could be applied to even larger containers. A significant advantage of the probe position device is the economy and relative simplicity of the design in comparison with prior devices. The probe can be accurately secured at a center position at any desired height in the flask relative to the bottom of the flask. The probe can be adjusted without removing the stopper from the flask. The probe positioning device is reusable and is useable with various types of probes. Further, the probe positioning device replicates the fluid flow path of a standard split-type stopper employed in freeze drying.

BRIEF DESCRIPTION OF DRAWINGS

The subject matter which is regarded as the present invention is particularly pointed out and distinctly claimed in the concluding portion of the specification. The invention, however, both as to organization and methods of practice, together with further objects and advantages thereof, may best be understood by reference to the following detailed description taken in conjunction with the accompanying drawings in which:

BEST MODE FOR CARRYING OUT THE INVENTION

Figure 1:
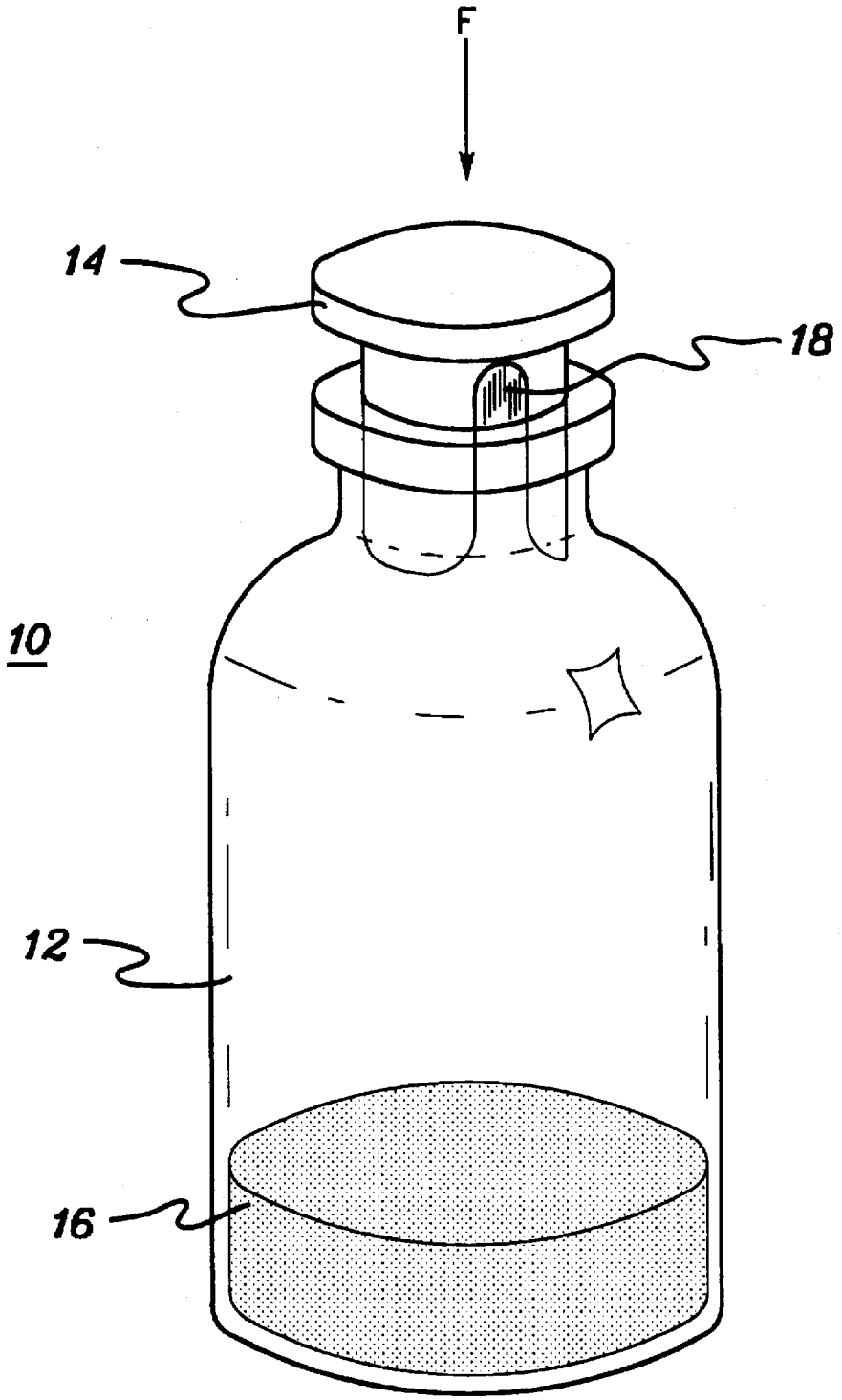
fig. 1 (PRIOR ART)
FIG. 1 is a perspective view of a flask and standard split-type stopper employed during the freeze drying process.

FIG. 1 depicts a conventional freeze drying flask assembly, generally denoted 10, which comprises a glass vial or flask 12 having an opening at one end within which a stopper 14 is disposed. (As used herein, the term "flask" encompasses any bottle, vial, or other type container used in the freeze drying process.) Stopper 14 includes side slits 18 which allow fluid communication between the interior of flask 12 and the surrounding environment. A material 16 undergoing freeze drying resides within flask 12 on a bottom surface. Flask assembly 10 is used in a conventional freeze drying apparatus. For example, reference the apparatus described in U.S. Pat. Nos. 3,286,366; 4,090,312; 4,197,658 and 4,597,188.

When stopper 14 is in the "up" position depicted in FIG. 1, a path for water vapor or other fluid to escape flask 12 is provided. Typically, flasks are introduced into the freeze dry process with their stoppers 14 in the up position, and remain that way until the drying cycle is complete. At the end of the cycle, freeze-drier shelves squeeze down on the flasks with a force 'F', thereby pressing the stoppers into a "down" position and sealing the flasks before the freeze drier door is opened. This assures that the contents of the flasks will not be contaminated after the process is complete. It also ensures that water vapor can not enter the vials and rehydrate the product once the drier doors are opened; in fact, the flasks are often repressurized at the end of the process with a dry inert gas, such as nitrogen, prior to pushing the stoppers into their down position. This is to maximize the shelf life of the freeze-dried product.

A tray within a conventional freeze dry apparatus may hold tens or hundreds of freeze dry flasks such as the flask of FIG. 1, each containing product to be dehydrated. Interspersed among the freeze dry flasks are one or more flasks containing probes for monitoring the freeze dry process. As noted above, the present invention is directed to a novel probe positioning device for facilitating this monitoring of the freeze dry process.

Figure 2:
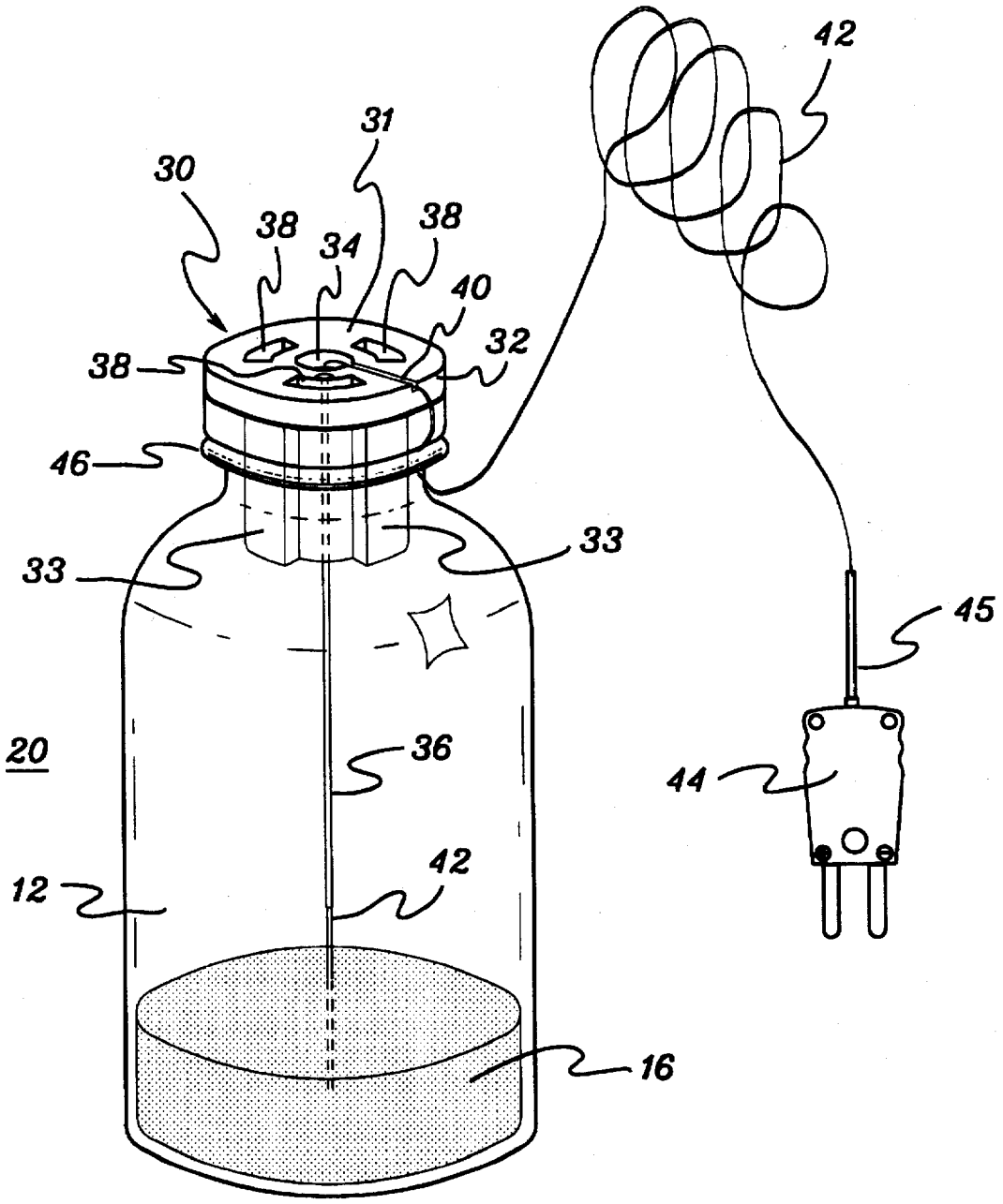
FIG. 2 is a perspective view of one embodiment of a probe positioning device and freeze drying flask in accordance with the present invention.

FIG. 2 depicts one embodiment of a freeze dry flask assembly, generally denoted 20, having a probe positioning device 30 in accordance with the present invention disposed at an open end of flask 12. Probe positioning device 30 comprises a specially designed stopper 32 having a disc-shaped cap 31 from which a cylindrical portion 33 depends. The diameter of cylindrical portion 33 is sized such that portion 33 engages and resides within the inner diameter of a neck of flask 12 defining the open end. A sensor 42, such as a thermocouple wire, is held in position within flask 12 within a guide tube 36 itself held within a center opening 34 of stopper 32.

Figure 3:
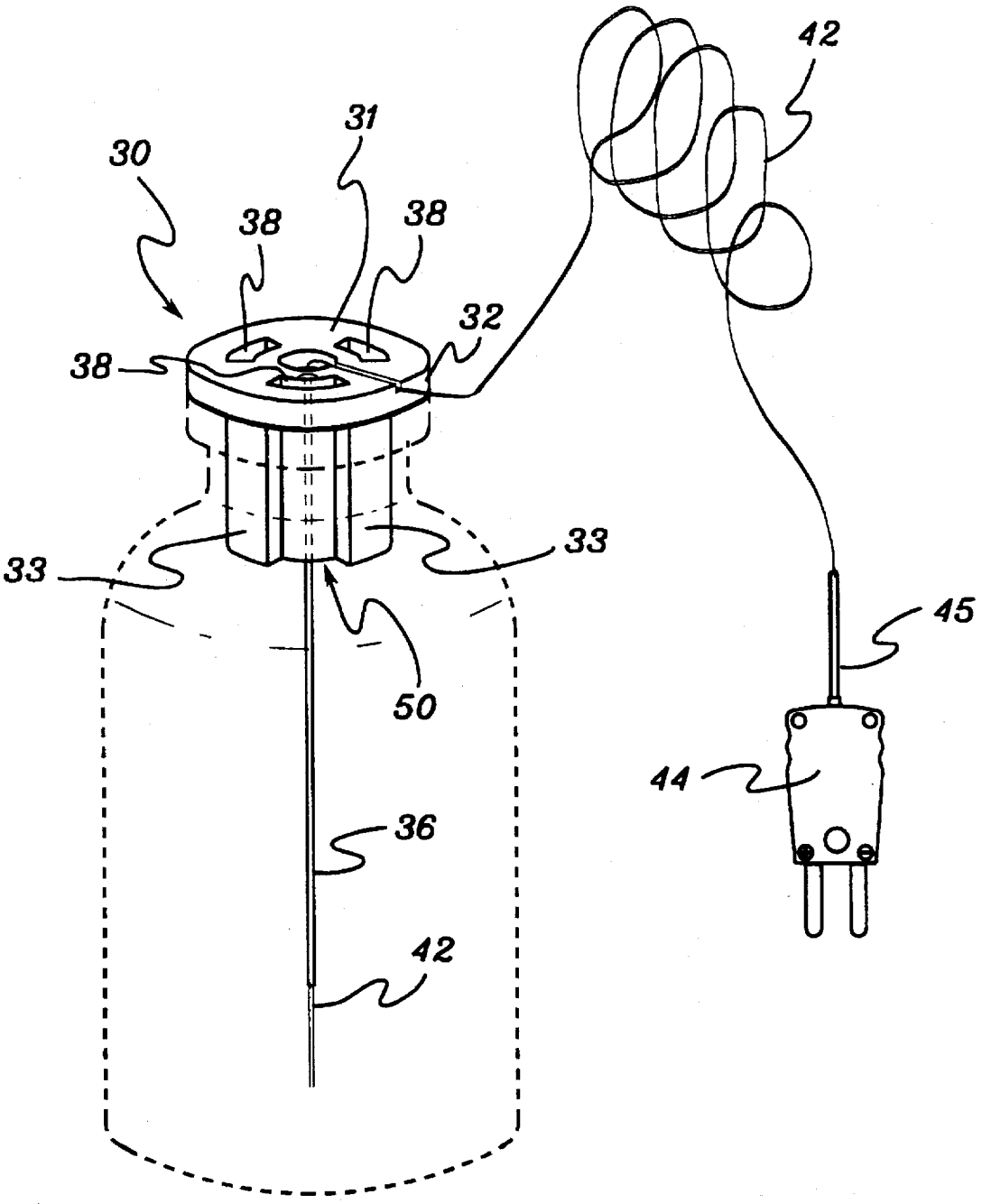
FIG. 3 is a perspective view of certain portions of the probe positioning device of FIG. 2.
Figure 5:
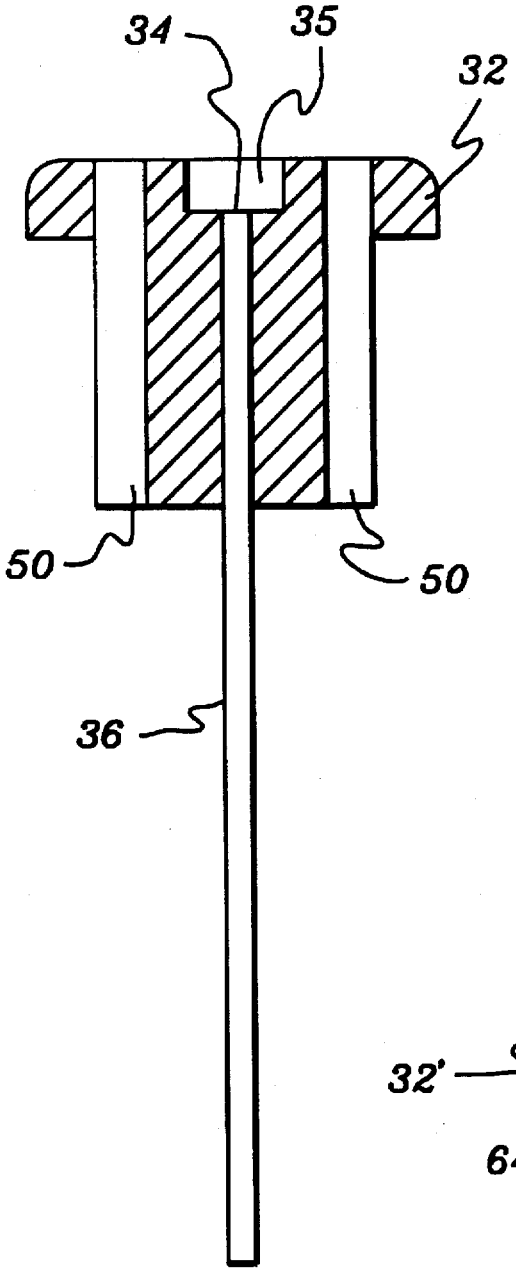
FIG. 5 is a cross-sectional view of the stopper and guide tube of FIG. 4 taken along lines A—A.
Figure 4:
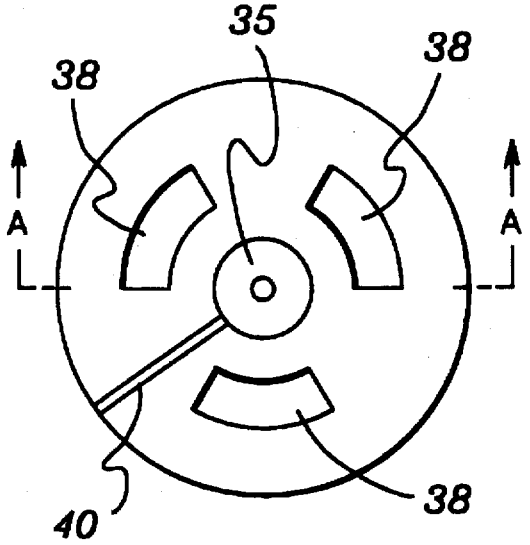
FIG. 4 is a top plan view of the stopper and guide tube of FIG. 3.

Probe positioning device 30 is shown in greater detail in FIGS. 3–5. Stopper 32 of device 30 preferably comprises an elastomer stopper which is autoclavable for sterile processes and, for example, made of silicone or butyl rubber. Center opening 34 through stopper 32 receives in secure engagement guide tube 36. Tube 36 may comprise a stainless steel tube of any of various lengths for compatibility with flasks of different height and for different stoppering applications. For example, 1 to 3½ inch length guide tubes may be employed with a flask in the range of 2 milliliters to 125 milliliters. Further, the diameter of guide tube 36 may vary depending upon the type of sensor to be held. For a 30 gauge thermocouple wire, a guide tube diameter of 0.065 inches may be appropriate.

In accordance with the present invention, stopper 32 includes at least one radial opening 38 disposed off center from opening 34. In the embodiment of these figures, three radial openings 38 are shown, each having an arcuate shape. These openings are aligned along a circle defined by a common radius such that a type of annular-shaped passageway is defined by radial openings 38. Further, openings 38 are symmetrically disposed within stopper 32. Each opening 38 is in communication with a respective channel 50 formed in the periphery of cylindrical portion 33 of stopper 32.

When employed with freeze drying flask 12, stopper 32 is secured to the open end of the flask, and radial openings 38 allow vapor communication between the inside of the flask and the exterior of the flask via the corresponding aligned channels 50. A significant consideration in sizing and locating radial openings 38 is that the vapor flow characteristics of a flask containing the probe positioning device 30 should mimic or be identical to vapor flow characteristics of a conventional freeze dry flask assembly having, for example, the standard split-type stopper design depicted in FIG. 1. Again, the purpose of a flask assembly having the probe positioning device herein is to monitor the freeze dry process within that flask as representative of the freeze dry process occurring within other flasks in the freeze dry apparatus. Center positioning of probe 42 within flask 12 is important since, as noted above, product in the center bottom of the flask is typically the last to freeze dry.

As shown in FIG. 2, guide tube 36 is sized so as not to physically contact product undergoing freeze drying. This ensures that the guide tube will not thermally conduct to the product and thereby cause erroneous monitoring of the freeze dry process. Flask assembly 20 in accordance with the present invention is designed to mimic the heat transfer properties of a standard vial and stopper such as depicted in FIG. 1. Probe 42 is held in position relative to guide tube 36 and flask 12 by either (or both) a channel 40 in cap 31 of stopper 32 or an O-ring 46 (FIG. 2) disposed over the neck of flask 12. If employed, channel 40 is sized to engageably receive probe wire 42 while O-ring 46 (FIG. 2) is sized to fit over the neck of flask 12 with probe wire 42 disposed therebetween. A center recess 35 (FIGS. 4 & 5) is provided in stopper 32 as a relief to prevent probe wire 42 from extending above the upper surface of stopper 32. Further, the thickness of cap 31 is designed to be the same thickness or less than the thickness of the cap portion of a conventional stopper employed in adjacent flasks in the freeze dry apparatus.

As one detailed example, probe 42 could comprise a thermocouple wire of any of various lengths. For example, type T, twinlead, 30 gauge wire (standard) could be employed in three foot or six foot lengths. However, other wire gauges are also available and, as noted, various length wires may be used. A plug 44 is disposed at the free end of thermocouple wire 42. This plug is preferably interchangeable with plugs currently in use in existing freeze dry apparatus. A wire jacket 45 prevents straining of the wire where coupled to plug 44. Probe positioning device 30 could be employed with a variety of plug configurations, including a lemo connector, a steam sterilizable connector or no connector.

Figure 6:
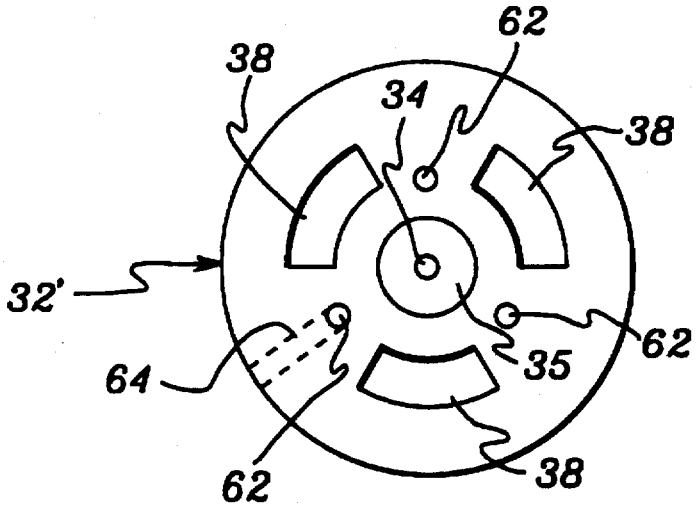
FIG. 6 is a top plan view of an alternate embodiment of a stopper in accordance with the present invention, wherein multiple guide tube openings are shown.

FIG. 6 depicts an alternate embodiment of a stopper, generally denoted 32' in accordance with the present invention. Stopper 32' includes three radial openings 38 symmetrically disposed at a common radial length from a center of the stopper. Stopper 32' also has a center opening 34 for accommodating a center guide tube (not shown). In this embodiment, three additional openings 62 are shown disposed between radial openings 38. Each opening 62 is sized to receive a guide tube, similar to guide tube 36 of FIGS. 2, 3 & 5. Each guide tube disposed within an opening 62 may extend into the flask the same or a different length, e.g., for facilitating monitoring of different product depths during the freeze dry process. Further, each opening 34, 62 may be the same or a different diameter to accommodate the same or different type probes for monitoring various characteristics of the freeze dry process. For example, by employing guide tubes of different length, it is possible to accurately measure progress of the freeze drying front as it recedes to the bottom of the flask. If desired, channels 64 could be formed in the upper surface of stopper 32' to accommodate the respective probe wires. Alternatively, a single O-ring about the neck of the flask with which the device is used could hold all probe wires fixed relative to the respective guide tubes.

Those skilled in the art will recognize from the above discussion that the present invention comprises a device which provides an easier way to adjust a center disposed thermocouple, or similar probe, within any sized freeze drying flask. A freeze drying flask with the probe positioning device of the present invention is easy to use, rugged, autoclavable and provides virtually no thermal path through the device to the product. The probe positioning device and associated flask can be adjacent to conventional flasks without impeding stoppering of the conventional flasks or interfering with the freeze drying process. A probe positioning device in accordance with this invention can be readily sized to fit flasks from 2 mil to 125 milliliters and larger, with various size neck openigns. A significant advantage of the probe position device is the economy and relative simplicity of the design in comparison with prior devices. The probe can be accurately secured at a center position at any desired height in the flask relative to the bottom of the flask. The probe can be adjusted without removing the stopper from the flask. The probe positioning device is reusable and is useable with various types of probes. Further, the probe positioning device replicates the fluid flow path of a standard split-type stopper employed in freeze drying.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

We claim:

1. A device for positioning a probe in a flask, said device comprising:

a stopper adapted to be secured to an open end of said flask, said stopper having a center opening and at least one radial opening spaced from said center opening, said at least one radial opening allowing for fluid communication between inside of said flask and outside of said flask when the stopper is secured to the open end of the flask; and a guide tube held within said center opening and extending into the flask when the stopper is secured to the open end of the flask, said guide tube being sized to receive the probe and allow the probe to extend from the guide tube into the flask, wherein said center opening with the guide tube and probe held therein allows substantially no fluid communication between the inside of the flask and the outside of the flask when the stopper is secured to the open end of the flask.

2. The device of claim 1, wherein the at least one radial opening comprises at least one arcuate-shaped radial opening in said stopper.

3. The device of claim 2, wherein said at least one arcuate-shaped radial opening comprises multiple arcuate-shaped radial openings disposed at a common length from the center opening in said stopper, wherein said multiple arcuate-shaped radial openings comprise an annular-shaped passageway for fluid communication between the inside and outside of the flask when the stopper is secured to the open end of the flask.

4. The device of claim 3, wherein the flask comprises a flask for freeze drying, and wherein the multiple arcuate-shaped radial openings are together sized and positioned to allow a same amount of fluid communication between the inside of the flask and the outside of the flask as compared with fluid communication through a standard slit-type stopper employed in freeze drying.

5. The device of claim 1, wherein the probe comprises a thermocouple wire and said device further comprises the thermocouple wire, said thermocouple wire being disposed within the guide tube such that a first portion extends into the flask when the stopper is secured to the open end of the flask and a second portion extends from the guide tube outside of the flask, and wherein the stopper includes a channel in an upper surface thereof sized to receive the thermocouple wire extending outside the flask to hold the thermocouple wire in fixed position relative to the guide tube.

6. The device of claim 1, wherein the open end of the flask resides at a neck of the flask, and the probe includes a probe wire, and wherein the device further comprises an O-ring, said O-ring being sized to engage the neck of the flask with the probe wire disposed between the neck and the O-ring, said O-ring holding the probe in fixed position relative to the guide tube when the stopper is secured to the open end of the flask.

7. The device of claim 6, wherein the stopper includes a channel in an upper surface thereof sized to receive the probe wire to further hold the probe in fixed position relative to the guide tube and to prevent the probe wire from extending above an upper surface of the stopper.

8. The device of claim 1, wherein the open end of the flask resides at a neck of the flask, and wherein the stopper comprises a disc-shaped member and a cylindrical member depending therefrom, said cylindrical member having a diameter sized to reside within and engage an inner diameter of the neck of the flask, and wherein each radial opening comprises an opening in said disc-shaped member aligned to a channel in said cylindrical member, each channel being formed in an outer periphery of said cylindrical member.

9. The device of claim 8, wherein said at least one radial opening comprises three arcuate-shaped radial openings in said disc-shaped member, each arcuate-shaped radial opening being aligned to a corresponding channel in said cylindrical member of said stopper.

10. The device of claim 1, wherein said stopper comprises an autoclavable elastomer stopper, said flask comprises a glass flask sized in a range from 2–125 milliliters, and said guide tube comprises stainless steel.

11. The device of claim 1, wherein the guide tube comprises a first guide tube and of center opening comprises a first guide tube opening, and wherein said device further comprises at least one additional guide tube opening in said stopper and at least one additional guide tube held within said at least one additional guide tube opening.

12. The device of claim 11, wherein the at least one radial opening comprises multiple radial openings, and wherein each additional guide tube openings is disposed between two adjacent radial opening of said multiple radial openings, and wherein said probe comprises multiple probe wires, each guide tube of said first guide tube and said at least one additional guide tube receiving a different probe wire of said multiple probe wires.

13. A device for positioning a probe in a flask for freeze drying, said device comprising:

a stopper adapted to be secured to an open end of said flask defined at a neck of the flask, said stopper having a center opening and multiple radial openings spaced from said center opening, each radial opening being disposed at a common radius from said center opening, wherein said multiple radial openings comprise an annular-shaped passageway for fluid communication between inside and outside of the flask when the stopper is secured to the open end of the flask, said stopper comprising a disc-shaped member and a cylindrical member depending therefrom sized to reside within an inner diameter of the neck of the flask, each radial opening comprising an arcuate-shaped opening in said disc-shaped member and a corresponding channel formed in an outer circumference of said cylindrical member; and a guide tube held within said center opening and extending into the flask when the stopper is secured to the open end of the flask, said guide tube being sized to receive the probe and allow the probe to extend from the guide tube into the flask, wherein said center opening with the guide tube and probe held therein allows substantially no fluid communication between the inside of the flask and the outside of the flask when the stopper is secured to the open end of the flask.

14. The device of claim 13, wherein said annular-shaped passageway is sized and positioned to allow a same amount of fluid communication between the inside of the flask and the outside of the flask compared with fluid communication through a standard slit-type stopper employed in freeze drying.

15. The device of claim 13, wherein the probe includes a probe wire, and wherein an upper surface of the disc-shaped member includes a channel sized to receive the probe wire for holding the probe wire in fixed position relative to the guide tube.

16. The device of claim 13, wherein the probe includes a probe wire, and wherein the device further comprises an O-ring sized to engage an outer diameter of the neck of the flask with the probe wire disposed between the O-ring and the neck to thereby hold the probe in fixed position relative to the guide tube when the stopper is secured to the open end of the flask.

17. The device of claim 16, further comprising a channel formed in an upper surface of the disc-shaped member, said channel being sized to receive the probe wire so that the probe wire resides below the upper surface of the disc-shaped member.

18. The device of claim 13, wherein the stopper comprises an elastomer stopper, the flask comprises a glass flask, and the guide tube comprises a stainless steel guide tube, and wherein the glass flask is sized in a range of 2 milliliters to 125 milliliters.

19. The device of claim 18, wherein said multiple radial openings comprise three radial openings in said elastomer stopper, and wherein said elastomer stopper comprises an autoclavable material, said autoclavable material comprising either silicone rubber or butyl rubber.

20. The device of claim 13, wherein the guide tube comprises a first guide tube and the center opening comprises a first guide tube opening, and wherein said device further comprises at least one additional guide tube opening in said stopper and at least one additional guide tube held within said at least one additional guide tube opening, each additional guide tube opening being disposed between two adjacent radial openings of said multiple radial openings, and wherein said probe comprises multiple probe wires, each guide tube receiving a different probe wire of said multiple probe wires.

21. The device of claim 20, wherein at least two guide tubes on said first guide tube and said at least one additional guide tube have different lengths such that the at least two guide tubes extend into the flask to different depths when the stopper is secured to the open end of the flask.

* * * * *